US008161673B1

(12) United States Patent
Kendall et al.

(10) Patent No.: US 8,161,673 B1
(45) Date of Patent: Apr. 24, 2012

(54) THREE-DIMENSIONAL PICTURE FRAME SYSTEM AND RELATED METHODS

(75) Inventors: William Kendall, Gilbert, AZ (US); Elaine Kendall, Gilbert, AZ (US); Diane Munson, Gilbert, AZ (US); Scott Munson, Gilbert, AZ (US)

(73) Assignee: Blaine Concepts, LLC, Gilbert, AZ (US)

( * ) Notice: Subject to any disclaimer, the term of this patent is extended or adjusted under 35 U.S.C. 154(b) by 158 days.

(21) Appl. No.: 12/782,567

(22) Filed: May 18, 2010

(51) Int. Cl.
*A47G 1/06* (2006.01)

(52) U.S. Cl. ..... 40/800; 40/737

(58) Field of Classification Search ..... 40/800; 206/561, 804, 817, 312; 211/189, 186; 190/103–105
See application file for complete search history.

(56) References Cited

U.S. PATENT DOCUMENTS

| | | | | |
|---|---|---|---|---|
| 83,797 | A | 11/1868 | Schmiff | |
| 452,925 | A | 5/1891 | Stoddard | |
| 4,182,061 | A | 1/1980 | English | |
| 4,850,125 | A | 7/1989 | Green | |
| 5,095,641 | A * | 3/1992 | Dahl | 40/721 |
| 5,174,054 | A | 12/1992 | Politi | |
| 5,197,213 | A | 3/1993 | Borden | |
| 5,335,433 | A | 8/1994 | Borden | |
| 5,950,288 | A | 9/1999 | Bach Lahor | |
| 7,082,653 | B1 | 8/2006 | Suppel | |
| 7,266,920 | B2 * | 9/2007 | Kao | 40/800 |
| 7,373,703 | B1 | 5/2008 | Grneci | |
| 7,418,796 | B2 | 9/2008 | Anastasio | |
| 8,042,294 | B2 * | 10/2011 | Snider et al. | 40/800 |

OTHER PUBLICATIONS http://www.sayanythingceramics.com/sand_ceremony_frames.php.

* cited by examiner

*Primary Examiner* — Joanne Silbermann
*Assistant Examiner* — Shin Kim
(74) *Attorney, Agent, or Firm* — Booth Udall, PLC

(57) ABSTRACT

A three dimensional picture frame comprising first and second vertical frame members, a bottom and top horizontal frame members coupled to opposite ends of the vertical frame members, front and rear transparent sheets located perpendicularly to the vertical and horizontal frame members to form a vessel, a backing sheet located perpendicularly to the first and second vertical frame members and the bottom and top horizontal frame members and outward from the rear transparent sheet such that when a material is placed in the vessel and a graphical sheet is placed between the backing sheet and rear transparent sheet, the graphical sheet is isolated from the material, and a plunger configured to slide downward in the vessel such that when a material is located in a portion of the vessel below the plunger, the material is prevented from entering a portion of the vessel above the plunger.

20 Claims, 5 Drawing Sheets

THREE-DIMENSIONAL PICTURE FRAME SYSTEM AND RELATED METHODS

BACKGROUND OF THE INVENTION

1. Field of the Invention

The present invention relates to systems and methods for commemoratively displaying photographs and other items in a three dimensional picture frame.

2. Description of Related Art

Many people find it desirable to display ornamental objects, souvenirs, or other keepsake items or materials along with a photograph or other graphical element as a reminder of a special occasion or event. A common problem that exists regarding this type of display is that current display devices may allow the keepsake items or materials to move freely within a container which may cause damage to the items or materials or they may prevent the keepsake items or materials from and photograph from being viewed simultaneously. Additionally, it may be difficult to place a photograph into current display devices once the keepsake items or materials are already present in the display device.

So as to reduce the complexity and length of the Detailed Specification, and to fully establish the state of the art in certain areas of technology, Applicant(s) herein expressly incorporate(s) by reference all of the following materials identified in each numbered paragraph below.

U.S. Pat. No. 5,950,288
U.S. Pat. No. 7,082,653
U.S. Pat. No. 4,182,061
U.S. Pat. No. 7,373,703
U.S. Pat. No. 7,418,796
U.S. Pat. No. 4,850,125
U.S. Pat. No. 5,335,433
U.S. Pat. No. 5,174,054
U.S. Pat. No. 5,197,213
U.S. Pat. No. 452,925
U.S. Pat. No. 83,797

For example, U.S. Pat. No. 7,082,653, incorporated above, discloses a picture frame having non-transparent container around the picture for holding cremation ashes or other materials. Thus, that material in the non-transparent container may not be viewed simultaneously with the photograph.

Applicants believe that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), Applicants will amend the specification to expressly recite the essential material that is incorporated by reference as allowed by the applicable rules.

BRIEF SUMMARY OF THE INVENTION

The present invention provides among other things systems and related methods of displaying commemorative items or materials along with a photograph or other graphical element in a three dimensional picture frame.

It is an object of the invention to isolate material in a vessel from a photograph or other graphical element that is simultaneously displayed.

It is another object of the invention to provide a three dimensional picture frame into which a photograph may be easily inserted without disturbing a keepsake item or material that is displayed with the photograph.

The above and other objects may be achieved using a three dimensional picture frame that comprises first and second vertical frame members, a bottom horizontal frame member coupled to a first end of each of the first and second vertical frame members and a top horizontal frame member removably coupled to an opposite end of each of the first and second vertical frame members. The device further comprises a front transparent sheet located perpendicularly to the first and second vertical frame members and the bottom and top horizontal frame members, a rear transparent sheet located perpendicularly to the first and second vertical frame members and the bottom and top horizontal frame members such that the frame members and transparent sheets form a vessel, a backing sheet located perpendicularly to the first and second vertical frame members and the bottom and top horizontal frame members and outward from the rear transparent sheet such that when a material is placed in the vessel and a graphical sheet is placed between the backing sheet and rear transparent sheet, the graphical sheet is isolated from the material and wherein the front and rear transparent sheets and backing sheet are substantially parallel to one another, and a plunger configured to slide downward in the vessel such that when a material is located in a portion of the vessel below the plunger, the material is prevented from entering a portion of the vessel above the plunger.

Some aspects of the invention may further comprise a top horizontal frame member further comprising two outer frame member lengths and a removable lid member that is configured to slidably couple to the two outer frame members. The first and second vertical frame members may each have a notch on an inner side to prevent the plunger from moving downward into a portion of the vessel that is below the notches.

The plunger may further comprise a horizontal bottom plunger member perpendicularly coupled to first ends of a first and a second vertical plunger member the vertical plunger members may be slidably coupled to the inner side of the vertical frame members. The horizontal bottom plunger member and first and second vertical plunger members may also be comprised of a single continuous piece of material.

In some aspects of the invention, the front and rear transparent sheets are comprised of glass and the backing sheet is comprised of a mounting board. The removable lid member may further comprise an indentation on an outer surface of the removable lid member. The frame members may also be comprised of wood.

The above and other objects may be achieved using methods comprising providing first and second vertical frame members, coupling a bottom horizontal frame member to a first end of each of the first and second vertical frame members, and removably coupling a top horizontal frame member to an opposite end of each of the first and second vertical frame members, locating a front transparent sheet perpendicularly to the first and second vertical frame members and the bottom and top horizontal frame members. The methods may further comprise locating a rear transparent sheet perpendicularly to the first and second vertical frame members and the bottom and top horizontal frame members such that the frame members and transparent sheets form a vessel, locating a backing sheet outwardly from the rear transparent sheet and perpendicularly to the first and second vertical frame members and the bottom and top horizontal frame members such that when a material is placed in the vessel and a graphical sheet is placed between the backing sheet and rear transparent sheet, the graphical sheet is isolated from the material and wherein the front and rear transparent sheets and backing sheets are located substantially parallel to one another, and providing a plunger configured to slide downward in the vessel such that when a material is located in a portion of the vessel below the plunger, the material is prevented from entering a portion of the vessel above the plunger.

Some aspects of the invention may further comprise methods in which the top horizontal frame member further comprises two outer frame member lengths and a removable lid member that is configured to slidably couple to the two outer frame members. The first and second vertical frame members may be configured to each have a notch on an inner side to prevent the plunger from moving downward into a portion of the vessel that is below the notches. The plunger may further comprise a horizontal bottom plunger member perpendicularly coupled to first ends of a first and a second vertical plunger member. The vertical plunger members may be are slidably coupled to the inner side of the vertical frame members.

In some aspects of the methods, the horizontal bottom plunger member and first and second vertical plunger members may be comprised of a single continuous piece of material. The front and rear transparent sheets are comprised of glass. The backing sheet may be comprised of a mounting board. The removable lid member may further comprise an indentation on an outer surface of the removable lid member and the frame members may be comprised of wood.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶ 6. Thus, the use of the words "function," "means" or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶ 6. Moreover, even if the provisions of 35 U.S.C. §112, ¶ 6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

One of ordinary skill in the art will also realize that while the three dimensional picture frame may be well suited for use during a wedding sand ceremony in which sand is poured into the vessel of the frame and a photograph is later added to the backing sheet, the vessel may be used to house other materials or keepsake items in an area that is separate from the area in which a photograph or graphical element is displayed.

Figure 1:
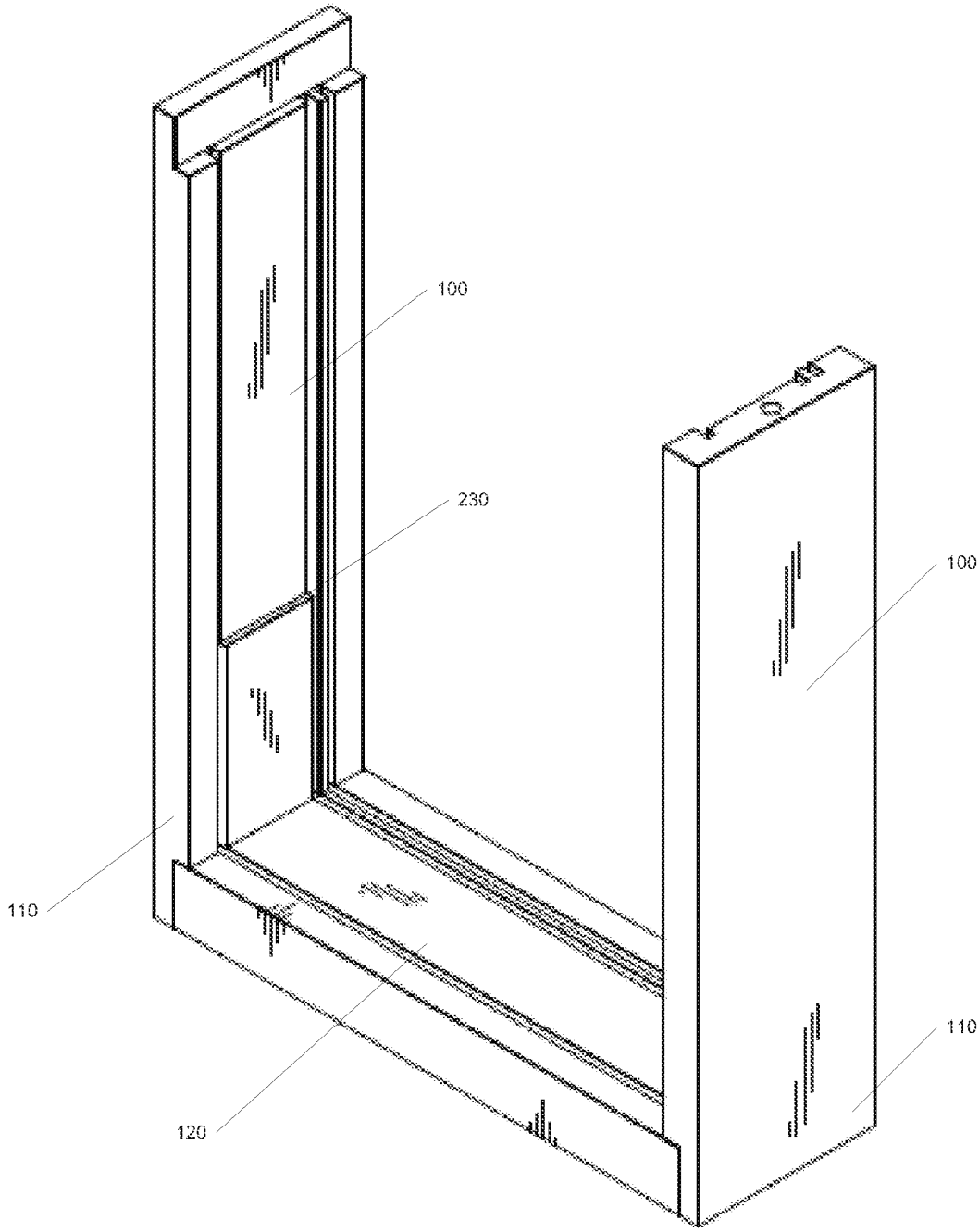
FIG. 1 depicts a perspective view of an implementation of frame members.
Figure 2:
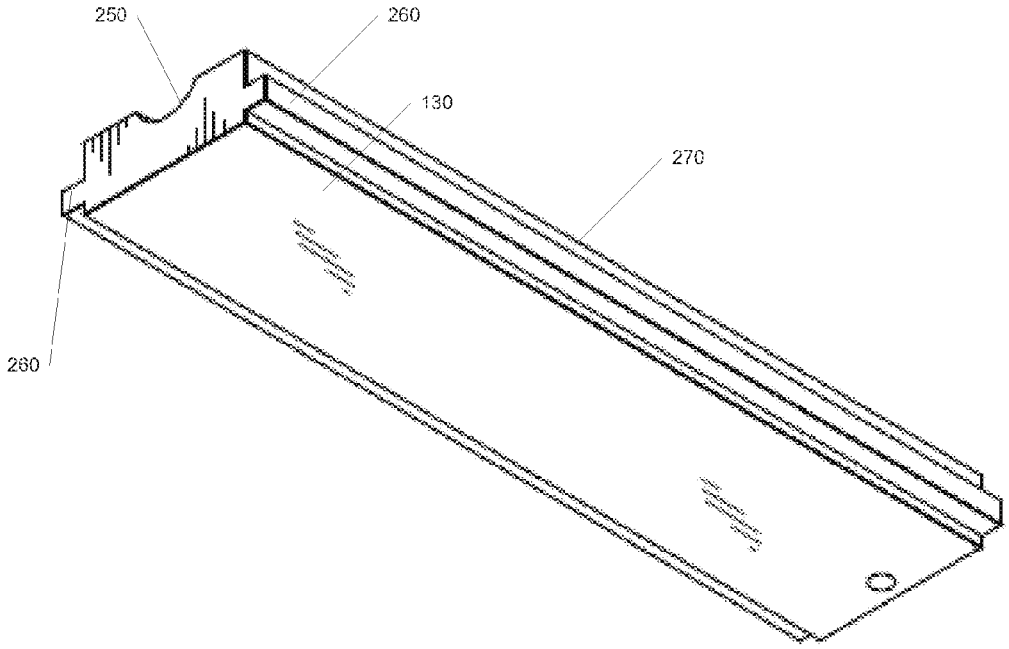
FIG. 2 depicts a bottom perspective view of a top horizontal frame member.

In one application of the invention, and as shown in FIGS. 1 and 2, a three dimensional picture frame is comprised of two vertical frame members 100, a bottom horizontal frame member 120 that is coupled to a first end 110 of each of the vertical frame members 100, and a top horizontal frame member 130 that is configured so as to removably couple with the opposite end 140 of each of the vertical frame members 100. The frame members may be comprised of wood, metal, synthetic materials, plastic, ceramic, or any other suitable material. In some implementations, it may be preferable to seal the junction points between frame members with a sealant such as but not limited to epoxy or silicone to prevent finer materials such as sand from leaking out of the interior vessel of the frame. The frame members may be coupled to one another using glue or any other adhesive, nails, screws, or any other fasteners known to one of ordinary skill in the art.

Figure 3:
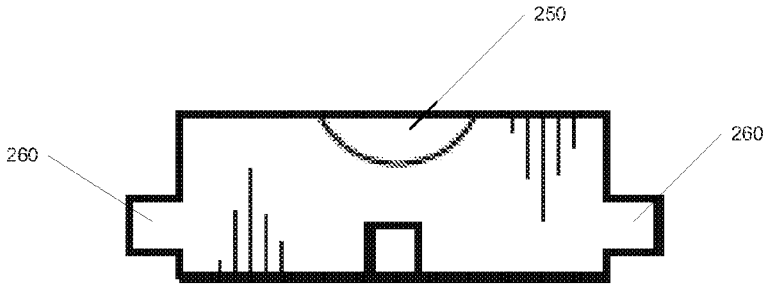
FIG. 3 depicts an end view of a top horizontal frame member.
Figure 4:
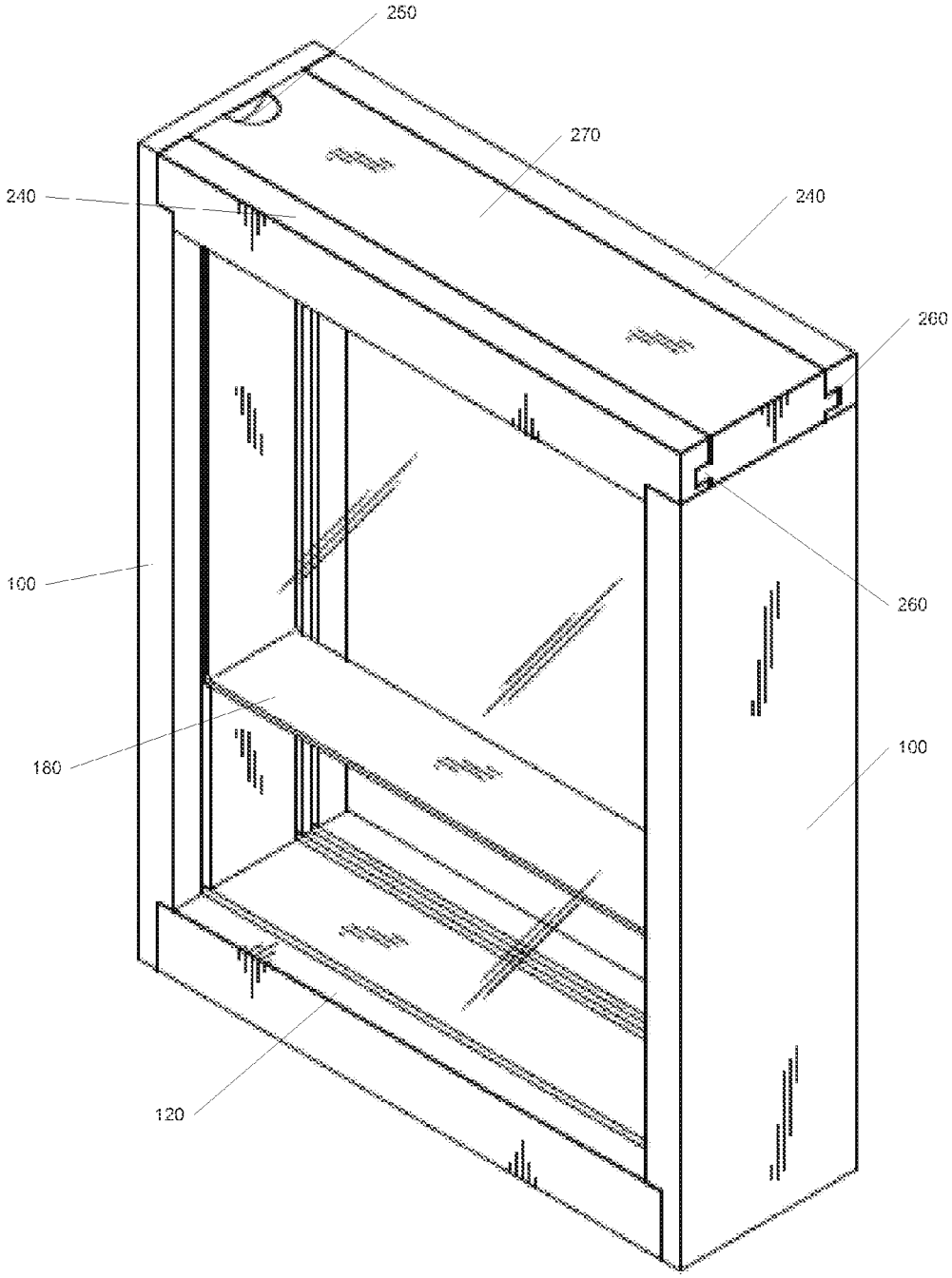
FIG. 4 depicts an implementation of a three dimensional picture frame.

As shown in FIGS. 2-4, the top horizontal frame member 130 may be further comprised of two outer frame member lengths 240 and a removable lid member 270. The removable lid member may have one or more flanges 260 extending outwardly and along the length of one or more sides of the removable lid member 270 such that the one or more flanges 260 slidably couple with a corresponding channel in the outer frame member lengths 240. The removable lid member may also have an indentation 250 to allow for ease of removal by a user.

Figure 5:
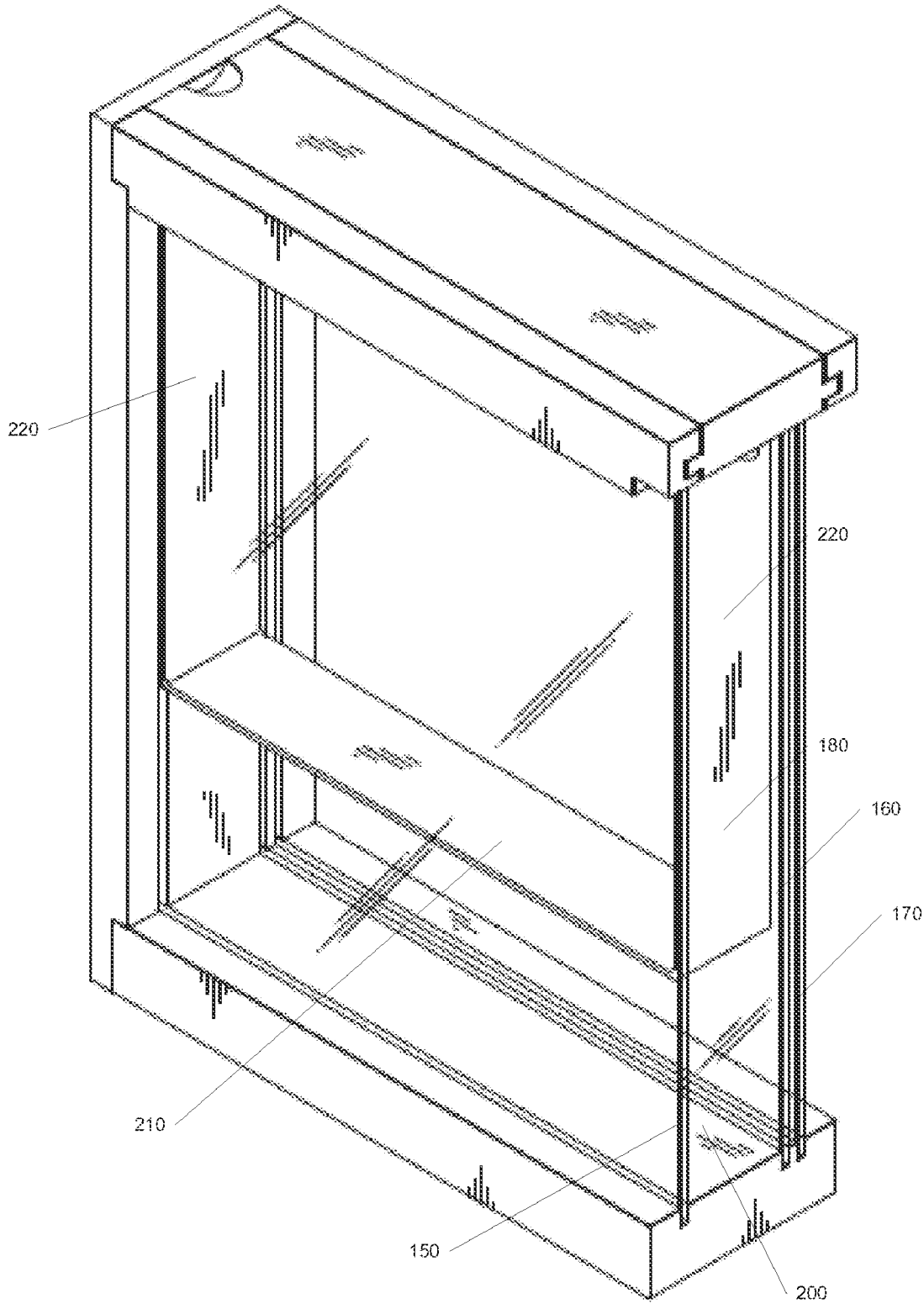
FIG. 5 depicts a cross-sectional view of an implementation of a three dimensional picture frame.

Referring to FIGS. 4 and 5, plunger 180 is configured to slide downward in vessel 200 to prevent any material that is in the lower portion of the vessel 200 from entering the portion of the vessel 200 that is above the plunger 180. One or both of the vertical frame members 100 may further comprise a horizontal notch 230 that prevents the plunger 180 from moving downward past the notch. Additionally, the overlap of the horizontal plunger member 210 with the notch 230 in the vertical frame members 100 may also improve the seal between the plunger 180 and the vertical frame members 100 so as to prevent finer materials such as, but not limited to, sand from leaking into the upper vessel portion as a result of movement of the three dimensional frame.

Plunger 180 may further be configured to comprise vertical plunger members 220 that slidably couple with the vertical frame members 100. The vertical plunger members may be coupled substantially perpendicularly to the ends of the horizontal plunger member 210 or the plunger 180 may be comprised of one continuous piece of material such as plastic, acrylic, or any other suitable material.

FIG. 5 depicts a cross-sectional view of a three dimensional picture frame having a front transparent sheet 150 located perpendicularly to the frame members at a point that is proximal to the front of the frame. Additionally, a rear transparent sheet 160 is located perpendicularly to the frame members at a point that is distal relative to the front of the frame. The space between the two transparent sheets as enclosed by the frame members forms a vessel 200 that may house keepsake items or other materials that one may desire to display in association with a photograph or graphical element. A backing sheet 170 is located perpendicularly to the frame members at a point that is closer to the back of the frame than that at which the rear transparent backing sheet 160 is located.

The transparent sheets 150, 160 may be comprised of glass, acrylic, or any other substantially transparent material and the backing sheet 170 may also be transparent or may be comprised of any other non-transparent material to which a photograph may be attached, such as, for example, a mounting board. While not limited as such, the frame members may further comprise grooves, channels, or notches in which to house the transparent sheets and backing sheet. A photograph or other graphical sheet may be mounted to the backing sheet 170 for display. This configuration thus separates the keepsake item or material from the photograph itself while allowing both the photograph and the keepsake material to be viewed simultaneously from the front of the three dimensional frame.

Figure 6:
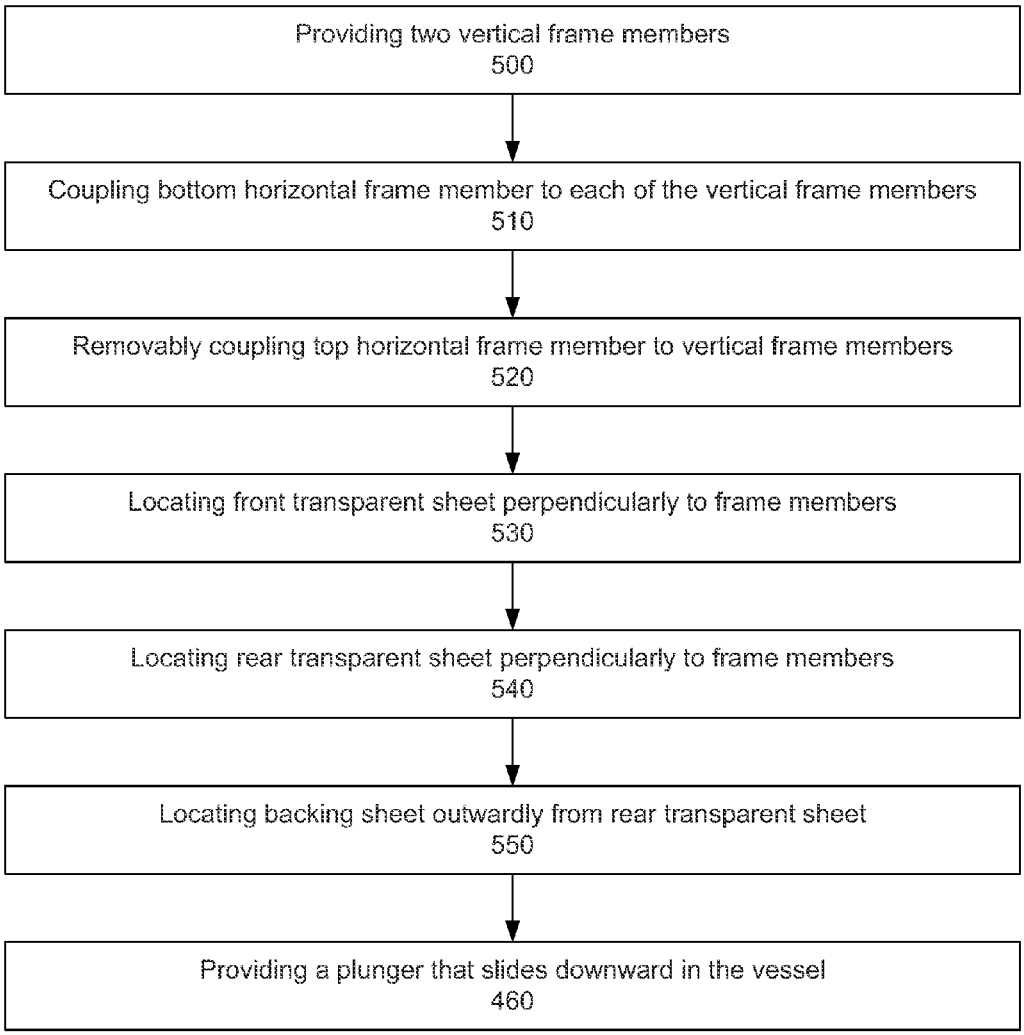
FIG. 6 is a block diagram of a method of making a three dimensional picture frame.

As shown in FIG. 6, a method of making a three dimensional picture frame may comprise providing first and second vertical frame members 400 and coupling a bottom horizontal frame member to a first end of each of the first and second vertical frame members 410. A top horizontal frame member is removably coupled to an opposite end of each of the first and second vertical frame members 420. A front transparent sheet may then be located perpendicularly to the first and second vertical frame members and the bottom and top horizontal frame members 430 and a rear transparent sheet is located perpendicularly to the first and second vertical frame members and the bottom and top horizontal frame members such that the frame members and transparent sheets form a vessel 440.

The method may further comprise locating a backing sheet outwardly from the rear transparent sheet and perpendicularly to the first and second vertical frame members and the bottom and top horizontal frame members such that when a material is placed in the vessel and a graphical sheet is placed between the backing sheet and rear transparent sheet, the graphical sheet is isolated from the material and wherein the front and rear transparent sheets and backing sheets are located substantially parallel to one another 450. Additionally, the method involves providing a plunger configured to slide downward in the vessel such that when a material is located in a portion of the vessel below the plunger, the material is prevented from entering a portion of the vessel above the plunger 460.

In places where the description above refers to particular implementations of three-dimensional picture frames, it should be readily apparent that a number of modifications may be made without departing from the spirit thereof and that these implementations may be applied to other types of picture frames and shadow boxes.

We claim:

1. A three dimensional picture frame comprising:

first and second vertical frame members;

a bottom horizontal frame member coupled to a first end of each of the first and second vertical frame members;

a top horizontal frame member removably coupled to an opposite end of each of the first and second vertical frame members;

a front transparent sheet located perpendicularly to the first and second vertical frame members and the bottom and top horizontal frame members;

a rear transparent sheet located perpendicularly to the first and second vertical frame members and the bottom and top horizontal frame members such that the frame members and transparent sheets form a vessel;

a backing sheet located perpendicularly to the first and second vertical frame members and the bottom and top horizontal frame members and outward from the rear transparent sheet such that when a material is placed in the vessel and a graphical sheet is placed between the backing sheet and rear transparent sheet, the graphical sheet is isolated from the material and wherein the front and rear transparent sheets and backing sheet are substantially parallel to one another; and a plunger configured to slide downward in the vessel such that when a material is located in a portion of the vessel below the plunger, the material is prevented from entering a portion of the vessel above the plunger.

2. The three dimensional picture frame of claim 1 wherein the top horizontal frame member further comprises two outer frame member lengths and a removable lid member that is configured to slidably couple to the two outer frame members.

3. The three dimensional picture frame of claim 2 wherein the removable lid member further comprises an indentation on an outer surface of the removable lid member.

4. The three dimensional picture frame of claim 1 wherein the first and second vertical frame members each have a notch on an inner side to prevent the plunger from moving downward into a portion of the vessel that is below the notches.

5. The three dimensional picture frame of claim 4 wherein the plunger further comprises a horizontal bottom plunger member perpendicularly coupled to first ends of a first and a second vertical plunger member.

6. The three dimensional picture frame of claim 5 wherein the vertical plunger members are slidably coupled to the inner side of the vertical frame members.

7. The three dimensional picture frame of claim 5 wherein the horizontal bottom plunger member and first and second vertical plunger members are comprised of a single continuous piece of material.

8. The three dimensional picture frame of claim 1 wherein the front and rear transparent sheets are comprised of glass.

9. The three dimensional picture frame of claim 1 wherein the backing sheet is comprised of a mounting board.

10. The three dimensional picture frame of claim 1 wherein the frame members are comprised of wood.

11. A method of making a three dimensional picture frame comprising:

providing first and second vertical frame members;

coupling a bottom horizontal frame member to a first end of each of the first and second vertical frame members;

removably coupling a top horizontal frame member to an opposite end of each of the first and second vertical frame members;

locating a front transparent sheet perpendicularly to the first and second vertical frame members and the bottom and top horizontal frame members;

locating a rear transparent sheet perpendicularly to the first and second vertical frame members and the bottom and top horizontal frame members such that the frame members and transparent sheets form a vessel;

locating a backing sheet outwardly from the rear transparent sheet and perpendicularly to the first and second vertical frame members and the bottom and top horizontal frame members such that when a material is placed in the vessel and a graphical sheet is placed between the backing sheet and rear transparent sheet, the graphical sheet is isolated from the material and wherein the front and rear transparent sheets and backing sheets are located substantially parallel to one another; and providing a plunger configured to slide downward in the vessel such that when a material is located in a portion of the vessel below the plunger, the material is prevented from entering a portion of the vessel above the plunger.

12. The method of claim 11 wherein the top horizontal frame member further comprises two outer frame member lengths and a removable lid member that is configured to slidably couple to the two outer frame members.

13. The method of claim 12 wherein the removable lid member further comprises an indentation on an outer surface of the removable lid member.

14. The method of claim 11 further comprising configuring the first and second vertical frame members to each have a notch on an inner side to prevent the plunger from moving downward into a portion of the vessel that is below the notches.

15. The method of claim 14 wherein the plunger further comprises a horizontal bottom plunger member perpendicularly coupled to first ends of a first and a second vertical plunger member.

16. The method of claim 15 wherein the vertical plunger members are slidably coupled to the inner side of the vertical frame members.

17. The method of claim 15 wherein the horizontal bottom plunger member and first and second vertical plunger members are comprised of a single continuous piece of material.

18. The method of claim 11 wherein the front and rear transparent sheets are comprised of glass.

19. The method of claim 11 wherein the backing sheet is comprised of a mounting board.

20. The method of claim 11 wherein the frame members are comprised of wood.

* * * * *